US006243927B1

(12) United States Patent
Matsushima et al.

(10) Patent No.: US 6,243,927 B1
(45) Date of Patent: Jun. 12, 2001

(54) SLIDE FASTENER

(75) Inventors: Hideyuki Matsushima; Kiyomasa Segawa, both of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/301,259

(22) Filed: Apr. 28, 1999

(30) Foreign Application Priority Data

Apr. 28, 1998 (JP) ..... 10-118238

(51) Int. Cl.[7] ..... A44B 19/02

(52) U.S. Cl. ..... 24/403; 24/405; 24/401; 24/406

(58) Field of Search ..... 24/403, 405, 406, 24/400, 399, 587, 577, 411, 413, 575, 576, 588, 590, 591

(56) References Cited

U.S. PATENT DOCUMENTS

| | | | | |
|---|---|---|---|---|
| 1,480,027 | * | 1/1924 | Statham | 24/406 |
| 1,703,924 | * | 3/1929 | Cobb | 24/406 |
| 1,732,787 | * | 10/1929 | Blair | 24/409 |
| 1,746,565 | * | 2/1930 | Sundback | 24/405 |
| 1,831,570 | * | 11/1931 | Krakowsky | 24/405 |
| 2,013,071 | * | 9/1935 | Sipe | 24/401 |
| 2,233,305 | * | 2/1941 | Burgeni | 24/405 |
| 2,517,402 | * | 8/1950 | Morin | 24/403 |
| 3,600,766 | * | 8/1971 | Alberts | 24/401 |
| 4,941,238 | * | 7/1990 | Clark | 24/587 X |
| 5,469,605 | * | 11/1995 | Horikawa | 24/403 |

FOREIGN PATENT DOCUMENTS

| | | | | |
|---|---|---|---|---|
| 657209 | * | 9/1951 | (GB) | 24/406 |

* cited by examiner

*Primary Examiner*—Robert J. Sandy
(74) *Attorney, Agent, or Firm*—Finnegan, Henderson, Farabow, Garrett & Dunner, L.L.P.

(57) ABSTRACT

The present invention provides a slide fastener in which a normal engaging state of engaging elements can be maintained, even if right and left tensile loads are applied to the engaged elements having an engaging male portion and an engaging female portion which can be engaged with and disengaged from each other in upward and downward directions. The engaging element having the engaging male portion has a tape mounting portion at one end thereof an arc-shaped fitting face at an inner face of the tape mounting portion, and a projecting engaging tongue at an upper portion of the element, at a lower face of which a column is formed to have an engaging head is formed at a tip end thereof. A recessed groove is defined in the head, thereby providing resilience. The engaging element having the engaging female portion has a tape mounting portion at an end thereof, a vertical fitting face at an inner face of the tape mounting portion, a projecting engaging tongue at a lower portion of the element. An engaging hole is defined in the engaging portion. A lock portion is formed at a lower face of the engaging hole for engagement with the engaging head. The engaging head of the engaging male portion and the lock portion of the engaging female portion are engaged with each other.

27 Claims, 15 Drawing Sheets

SLIDE FASTENER

BACKGROUND OF THE INVENTION

1. Field of the Invention

The present invention relates to a slide fastener which can be used for clothes, bag, and the like, and wherein engaging elements which are independent of each other are mounted to edge portions of fastener tapes at constant intervals, the engaging elements are placed with one upon another, and an engaging male portion and an engaging female portion respectively formed on the upper and lower engaging elements can be engaged with and disengaged from each other in upward and downward directions.

2. Description of the Related Art

As a conventional slide fastener of this type, there is a slide fastener as disclosed in Japanese Patent Publication No. 53-2091, wherein independent engaging elements 1' are mounted to opposed edge portions of a pair of fastener tapes 2' at constant intervals, the engaging elements 1' are placed with one upon another such that the elements 1' can be engaged with and detached from each other in upward and downward directions, the one engaging element 1' is formed with a spherical projection as an engaging male portion 6', the other engaging element is formed with a fitting hole as an engaging female portion 7' to be snap-fitted with the spherical projection, and the engaging elements 1' can be engaged with and detached from each other in upward and downward directions by a sliding movement of the slider 3', as shown in FIG. 27.

In the slide fastener described in the preceding paragraph and shown in FIG. 27, when the engaging elements are placed with one upon another and engaged with each other by the sliding slider, the right and left fastener tapes mounted with the engaging elements are not in the same plane. Therefore, if a tensile load is applied to the right and left fastener tapes, a rotation moment acts on the engaged engaging elements. As a result, the engagement of the elements may be easily cancelled and the elements may be detached from each other. Therefore, the slide fastener suffers from a problem of unstableness.

Furthermore, because tip ends of the engaging elements are exposed in a state wherein the right and left engaging elements are placed with one upon another and are engaged with each other, the tip ends of the engaging elements are caught on other articles when the slide fastener is used, and the engagement of the engaging elements may be easily cancelled and the elements may be detached from each other, thereby causing a fastener chain split.

SUMMARY OF THE INVENTION

The present invention has been accomplished with the above problems in view, and it is a first object of the invention to provide a slide fastener, wherein right and left fastener tapes are disposed in the same plane, and even if right and left tensile loads are applied to engaged engaging elements, the engaging elements are not easily displaced due to falling or rotating, thereby maintaining a regular engaging state without canceling of engagement of the engaging elements and detachment of the elements. The slide fastener is durable, firm, and presentable.

It is a second object of the invention to provide a slide fastener which is extremely presentable, wherein the engaging elements are formed into such shapes that a rotation moment hardly acts on the engaging elements even if tensile loads are applied to the right and left fastener tapes, thereby facilitating a smooth sliding operation of the slider.

It is a third object of the invention to provide a slide fastener which is extremely presentable, wherein the engaging elements are formed into such shapes that rotation and deviation of the engaging elements are prevented by the engaging elements themselves even if rotation moment acts on the engaging elements as a result of tensile loads applied to the right and left fastener tapes, thereby facilitating the smooth sliding operation of the slider.

It is a fourth object of the invention to provide a slide fastener, wherein the rotation moment hardly acts on the engaging elements by specifying the shapes of the right and left engaging elements, and the engaging elements can be manufactured and mounted easily.

It is a fifth object of the invention to provide a slide fastener, wherein the engaging elements are not rotated or displaced even if rotation moment acts on the engaging elements by specifying the shapes of the right and left engaging elements, and the engaging elements can be manufactured and mounted easily.

It is a sixth object of the invention to provide a slide fastener which is extremely presentable, wherein the engaging elements are not rotated or displaced even if the rotation moment acts on the engaging elements, and the engaging elements can be formed to be thin.

It is a seventh object of the invention to provide a slide fastener, wherein various kinds of engaging portions are formed by specifying the engaging portions of the engaging elements, the slide fastener has a desirable engaging function, and engaging and disengaging operations of the slide fastener can be carried out extremely easily.

It is an eighth object of the invention to provide a slide fastener, wherein the engaging male portion and the engaging female portion can be engaged with each other extremely easily by specifying a shape of the engaging male portion disposed in the engaging element, and a sliding operation of the slider can be carried out extremely smoothly.

It is a ninth object of the invention to provide a slide fastener, wherein the slide fastener can be manufactured with one kind of engaging element which means that it is unnecessary to differently manufacture the right and left engaging elements, by symmetrically disposing a plurality of engaging portions on the engaging element, and the slide fastener has effective engaging and disengaging functions.

It is a tenth object of the invention to provide a slide fastener, wherein a fitting state of the engaging elements with the slider is stabilized by specifying the shapes of the engaged engaging elements, and the engaging elements can be engaged and disengaged from each other easily and smoothly.

According to the main aspect of the invention, there is provided a slide fastener comprising discrete engaging elements which include engaging portions each having an engaging male portion and an engaging female portion to be engaged with and disengaged from each other in upward and downward directions and which are disposed on opposed edge portions of a pair of fastener tapes at constant intervals, and a slider including a guide portion formed laterally, in which the right and left fastener tapes, to which the opposed engaging elements are mounted are disposed in the same plane, and the opposed engaging elements are formed into such shapes that the engaging elements can not be displaced as a result of rotating or falling due to right and left tensile loads applied in engagement of the engaging elements.

Preferably, an engaging contact point between the engaging male portion and the engaging female portion of the engaging portions of the opposed engaging elements mounted to the right and left fastener tapes is in a plane where the right and left fastener tapes exist, and thus, the opposed engaging elements themselves are formed such that the engaging elements can not be displaced as a result of rotating or falling.

Further preferably, fitting faces which can abut on tip ends of the opposed engaging elements are formed in vicinity of tape mounting portions of the opposed engaging elements mounted to the right and left fastener tapes, and the opposed engaging elements themselves are formed such that the engaging elements can not be displaced as a result of rotating or falling.

Preferably, the opposed engaging elements have substantially L shapes in section in a lateral direction of a fastener chain, the engaging elements are defined at one ends thereof to be thick tape mounting portions and at the other ends thereof to be flat engaging tongues projecting from the tape mounting portions, the engaging elements are placed with one upon another while holding each other, the engaging male portion is formed to project from one of opposed faces of the elements, the engaging female portion is defined to be recessed in the other of the opposed faces, and the engaging contact point of the engaging portions is in the plane where the right and left fastener tapes exist when the engaging male portion and the engaging female portion are engaged with each other.

And preferably, the opposed engaging elements have substantially L shapes in section in a lateral direction of a fastener chain, the engaging elements are defined at one ends thereof to be the thick tape mounting portions and at the other ends thereof to be flat engaging tongues projecting from the tape mounting portions, the engaging elements are placed with one upon another while holding each other, the engaging male portion is formed to project from one of opposed faces of the opposed engaging elements, the engaging female portion is defined to be recessed in the other of the opposed faces, and the vertical fitting faces are formed in the vicinity of the tape mounting portions so as to abut on the tip ends of the engaging tongues of the opposed engaging elements.

Still preferably, the engaging contact point in the engaging portion between the opposed engaging elements is disposed at a position deviated downward from the plane where the right and left fastener tapes exist, and the arc-shaped fitting face for receiving and abutting on the arc-shaped tip end of the engaging tongue of the lower engaging element is formed in the upper engaging element.

Preferably, the engaging male portion of the engaging portion of the engaging elements mounted to the right and left fastener tapes is formed into a bulging engaging head which can be resiliently deformed, and the engaging female portion to be engaged with the engaging male portion is formed into a through hole-shaped engaging hole which can not be deformed.

Alternatively, the engaging male portion of the engaging portions of the engaging elements mounted to the right and left fastener tapes is formed into a bulging engaging head which can not be deformed, and the engaging female portion to be engaged with the engaging male portion is formed into a through hole-shaped engaging hole which can be resiliently deformed.

Still alternatively, the engaging male portion of the engaging portion of the engaging elements mounted to the right and left fastener tapes is formed into a bulging engaging head which can be resiliently deformed, and the engaging female portion to be engaged with the engaging male portion is formed into a through hole-shaped engaging hole which can be resiliently deformed also.

And preferably, the bulging engaging head defined on the engaging male portion of the engaging element mounted to the edge portion of the fastener tape projects only in a longitudinal direction of the fastener chain and does not project sideways.

Preferably, a plurality of engaging portions having engaging male portion and the engaging female portion are symmetrically disposed respectively on the opposed faces of the opposed engaging elements.

Further preferably, a wedge-shaped gap portion is defined at least at a front end of the opposed engaging elements, i.e. at an end portion of the engaging elements on a shoulder opening side of the slider into which the fastener chain is inserted when the engaging elements mounted to the right and left fastener tapes are engaged with each other, the acute-angled guide portion of the slider corresponds to the gap portion, and the engaged engaging elements are separated by the guide portion of the slider by a sliding movement of the slider, thereby opening the fastener chain.

DESCRIPTION OF THE PREFERRED EMBODIMENTS

Embodiments of the present invention will be specifically described below by reference to the drawings.

In a slide fastener of the invention, a fastener chain comprising discrete engaging elements 1 mounted to longitudinal edge portions on one side of each of a pair of fastener tapes 2 is opened and closed by a sliding movement of a slider 3. The fastener tapes 2 are each formed by weaving or knitting synthetic fiber yarn of polyamide series, polyester series, and the like, and weaving or knitting core strings into longitudinal edges to form core portions 4 or sewing the core strings with sewing yarn to integrally form the core portions 4. The fastener tapes 2 are not necessarily formed with the core portions 4, but may be flat.

The discrete engaging elements 1 of the slide fastener are integrally molded on and mounted to the core portions 4 on the longitudinal edges of the pair of fastener tapes 2 or on the flat fastener tapes 2 by injection molding processing means or by extrusion processing means by using thermoplastic resin such as polyamide, polyacetals, polypropylene, polybutylene terephthalate, and the like at constant intervals.

Figure 1:
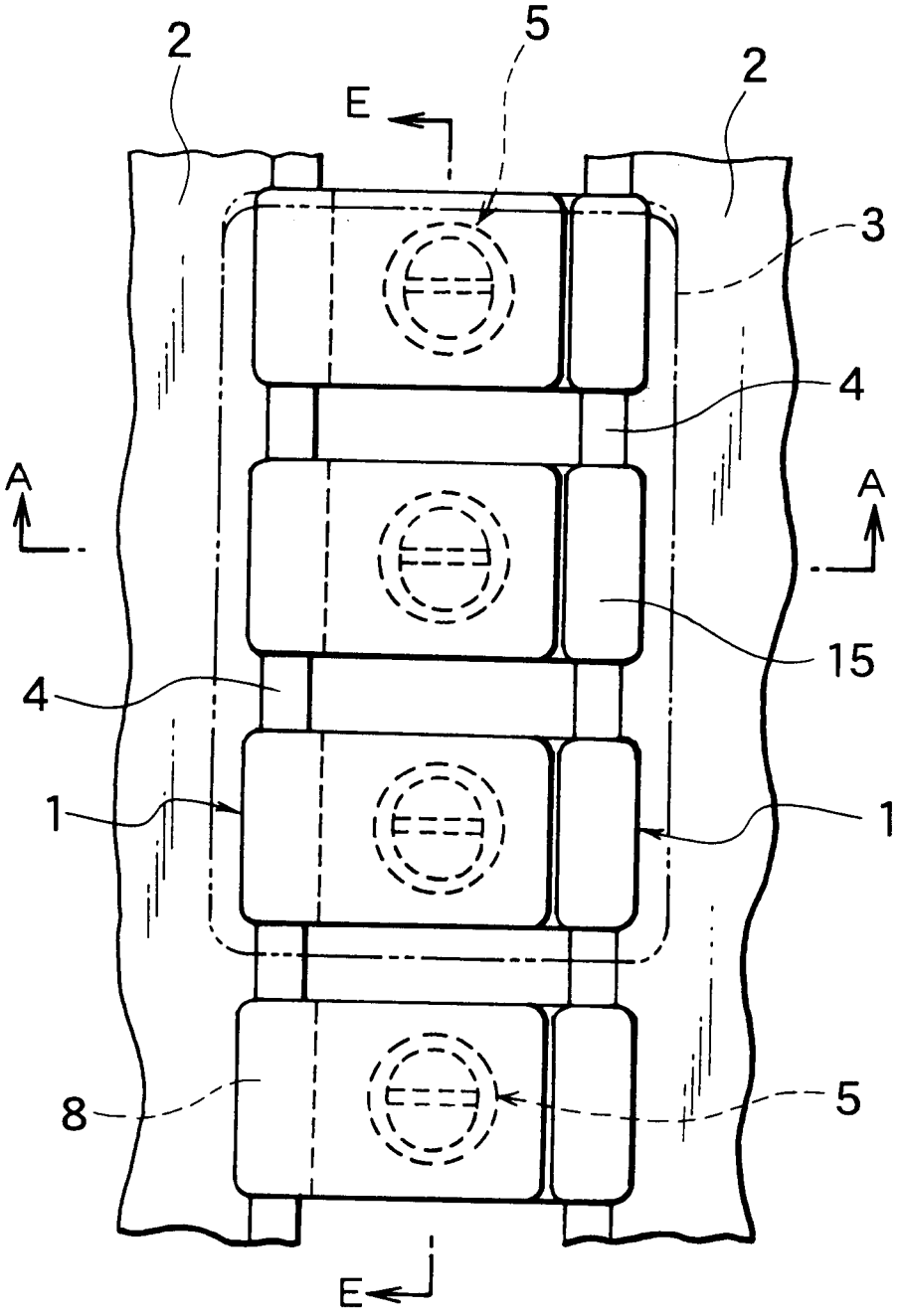
FIG. 1 is a front view of an essential portion of a first embodiment of a slide fastener.
Figure 2:
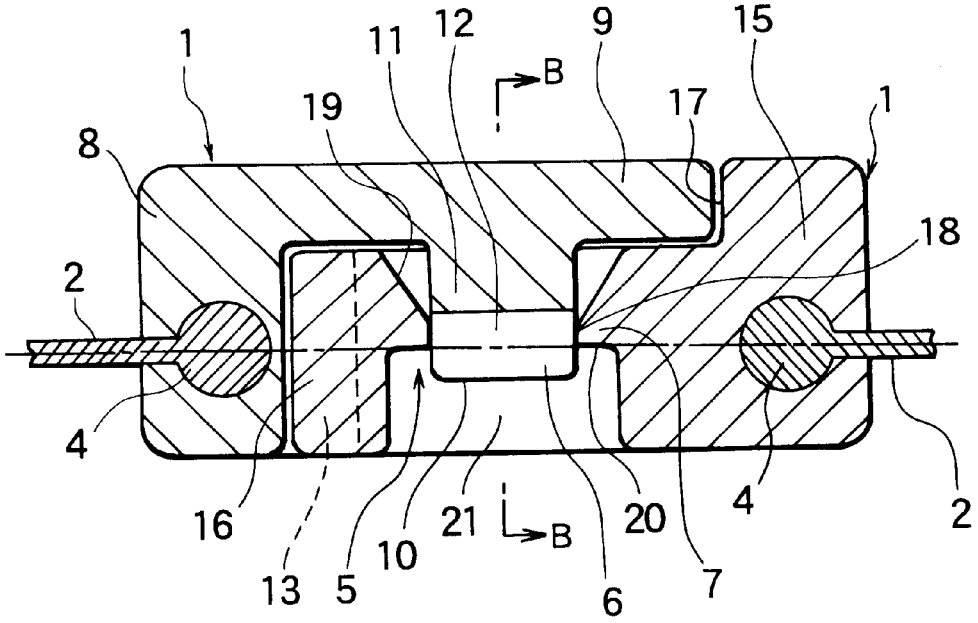
FIG. 2 is a sectional view of the slide fastener taken along a line A—A in FIG. 1.
Figure 3:
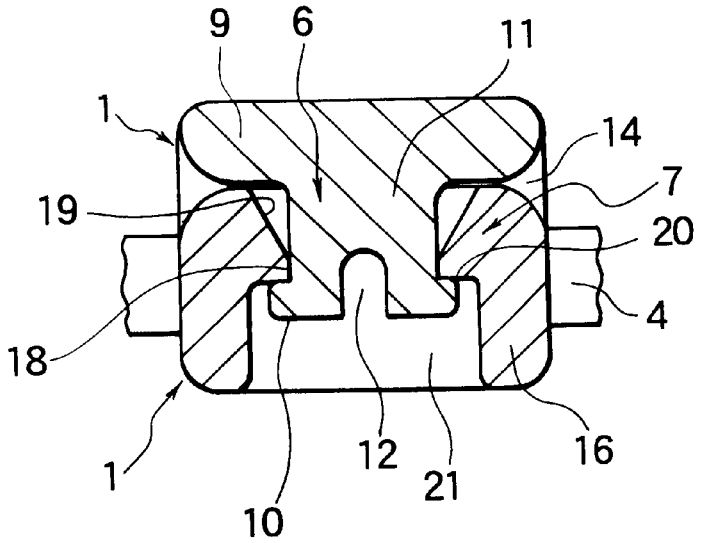
FIG. 3 is a sectional view of the slide fastener taken along a line B—B in FIG. 2.
Figure 4:
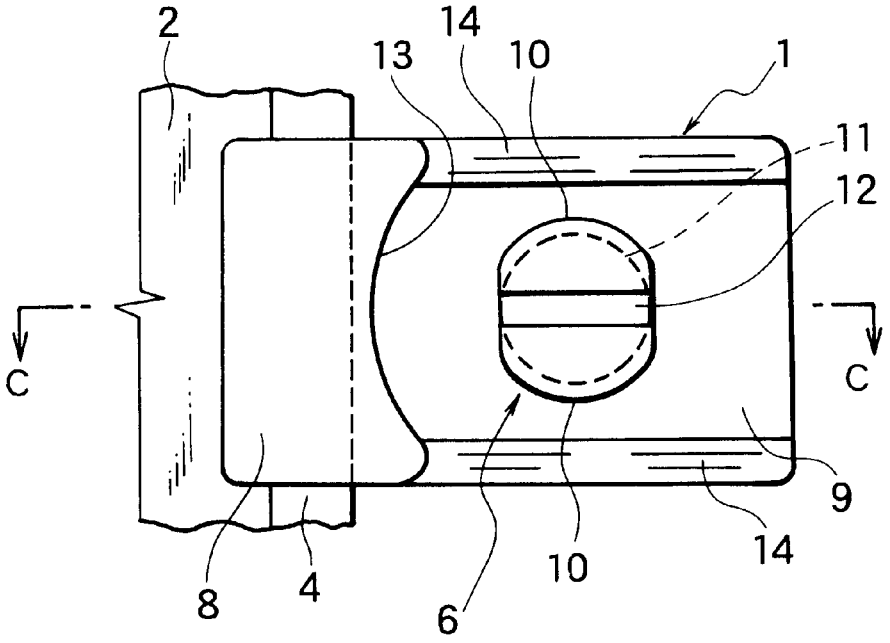
FIG. 4 is a plan view of an engaging element having an engaging male portion in the slide fastener.
Figure 5:
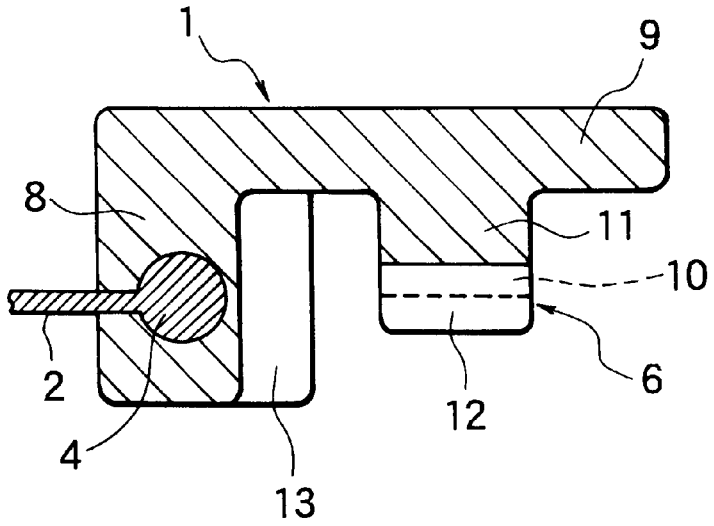
FIG. 5 is a sectional view of the engaging element of the slide fastener taken along a line C—C in FIG. 4.

In a first embodiment of the slide fastener shown in FIGS. 1 to 10, a pair of engaging elements 1, 1 having engaging portions 5 comprising an engaging male portion 6 and an engaging female portion 7 are integrally molded on core portions 4 of fastener tapes 2, 2, respectively. One of the engaging elements 1 having the engaging male portion 6 has at an end thereof a thick tape mounting portion 8 to be mounted on the fastener tape 2. A flat engaging tongue 9 is formed to project from a position of the tape mounting portion 8 deviated upward, and the engaging male portion 6 is formed to project downward from a center portion of the engaging tongue 9 as shown in FIG. 5. As shown in FIG. 4, the engaging male portion 6 has a bulging engaging head 10 bulging from a tip end of a column 11 forward and backward, i.e., in a longitudinal direction of the fastener chain. A U-shaped recessed groove 12 deeper than a disposing position of the engaging head 10 is formed across the engaging head 10 in a top face of the engaging head 10, thereby enabling the engaging head 10 to be resiliently deformed longitudinally and providing resilience.

Top and bottom end portions of an inner wall face of the tape mounting portion 8 extend toward an inside of the fastener chain to form a surface of the inner wall face into an arc-shaped vertical fitting face 13 such that an arc-shaped tip end of an engaging tongue 16 of the mating engaging element 1 is received by the fitting face 13 and abuts on the fitting face 13. Furthermore, top and bottom lower end edges of the engaging portion 9 are chamfered into arc shapes so as to form a wedge-shaped gap portion 14 between the engaging portion 9 and the engaging portion 16 of the opposite engaging element 1, as shown in FIG. 3. The gap portion 14 faces a guide portion 31 which is formed inside the slider 3 for guiding the engaging elements 1 and facilitates insertion of the guide portion 31.

Figure 6:
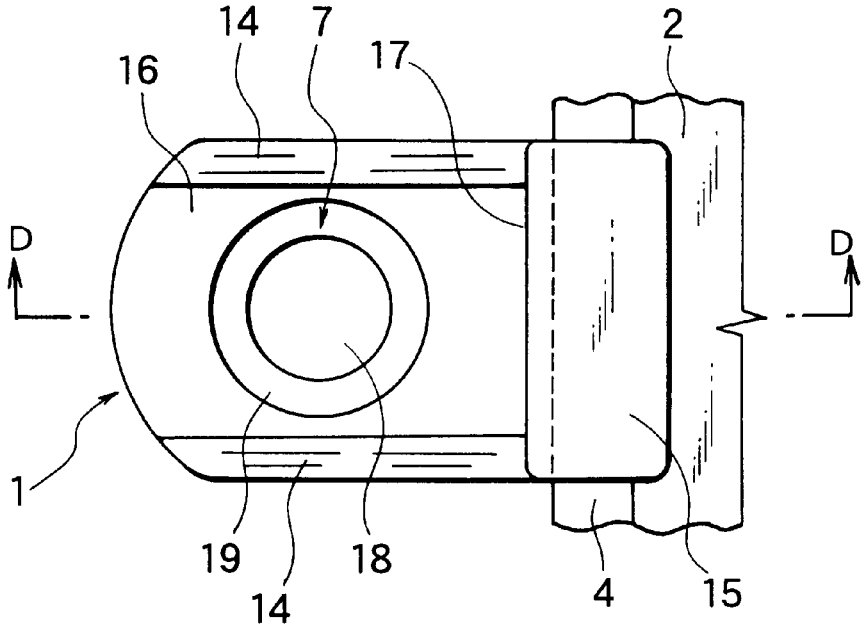
FIG. 6 is a plan view of an engaging element having an engaging female portion in the slide fastener.
Figure 7:
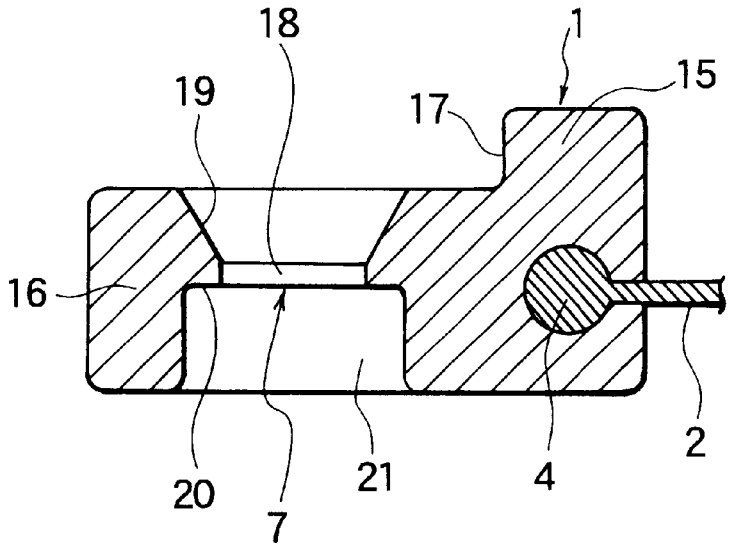
FIG. 7 is a sectional view of the engaging element of the slide fastener taken along a line D—D in FIG. 6.

On the other hand, the engaging element 1 having the engaging female portion 7 is provided at an end thereof with a thick tape mounting portion 15 to be mounted with the fastener tape 2. The flat engaging tongue 16 projects from a position of the tape mounting portion 15 deviated downward. A vertical flat fitting face 17 is formed on an upside inner wall face of the tape mounting portion 15 such that the fitting face 17 can abut on a tip end of the vertical face of the engaging tongue 9 of the opposite engaging element 1. The engaging tongue 16 is defined at a center portion thereof with a through hole-shaped engaging hole 18 vertically penetrating the engaging portion 16, thereby forming the engaging female portion 7. As shown in FIGS. 6 and 7, the engaging female portion 7 is the engaging hole 18 which is composed of a circular through hole. An peripheral edge of the engaging hole 18 is formed to be a tapered face 19 with a diameter increasing toward an engaging entrance side such that the bulging engaging head 10 formed in the engaging male portion 6 can be easily fitted into the engaging hole 18. The peripheral edge of the engaging hole 18 of the engaging female portion 7 at a center of the engaging hole 18 in a vertical direction, i.e. at a position which is on a center line of the tape mounting portion 15 projects toward a center of the engaging hole 18 so as to form a lock portion 20, thereby forming an engaging recessed portion 21 to be engaged with the engaging head 10 of the engaging male portion 6.

A tip end of the engaging portion 16 is formed into an arc shape such that the tip end can be received by and abut on the arc-shaped fitting face 13 formed on the mating engaging element 1. Furthermore, as shown in FIG. 3, top and bottom edge portions of the engaging tongue 16 are chamfered into arc shapes so as to form the wedge-shaped gap portion 14 between the engaging tongue 16 and the engaging tongue 9 of the mating engaging element 1, thereby facilitating insertion of the guide portion 31 formed inside the slider 3.

The pair of engaging elements 1, 1 as described above are mounted to longitudinal edges of the right and left fastener tapes 2, 2. The slider 3 shown in FIGS. 8 to 10 comprises a guide groove 30 which extends from a shoulder opening to a rear opening at an upper portion of the slider 3 and which guides the engaging elements 1 disposed on an upper side and the guide groove 30 which is formed at a lower portion of the slider 3 and which guides the engaging elements 1 disposed on a lower side, for example. The guide grooves 30 disposed on upper and lower sides are connected to each other at their midway portions to be one guide groove 30. The guide portion 31 is formed in a lateral direction at the intersecting point of the guide grooves 30 for engaging and disengaging both the engaging elements 1, 1. A reference numeral 32 in the drawings designates a guide flange for guiding the engaging element 1.

Figure 8:
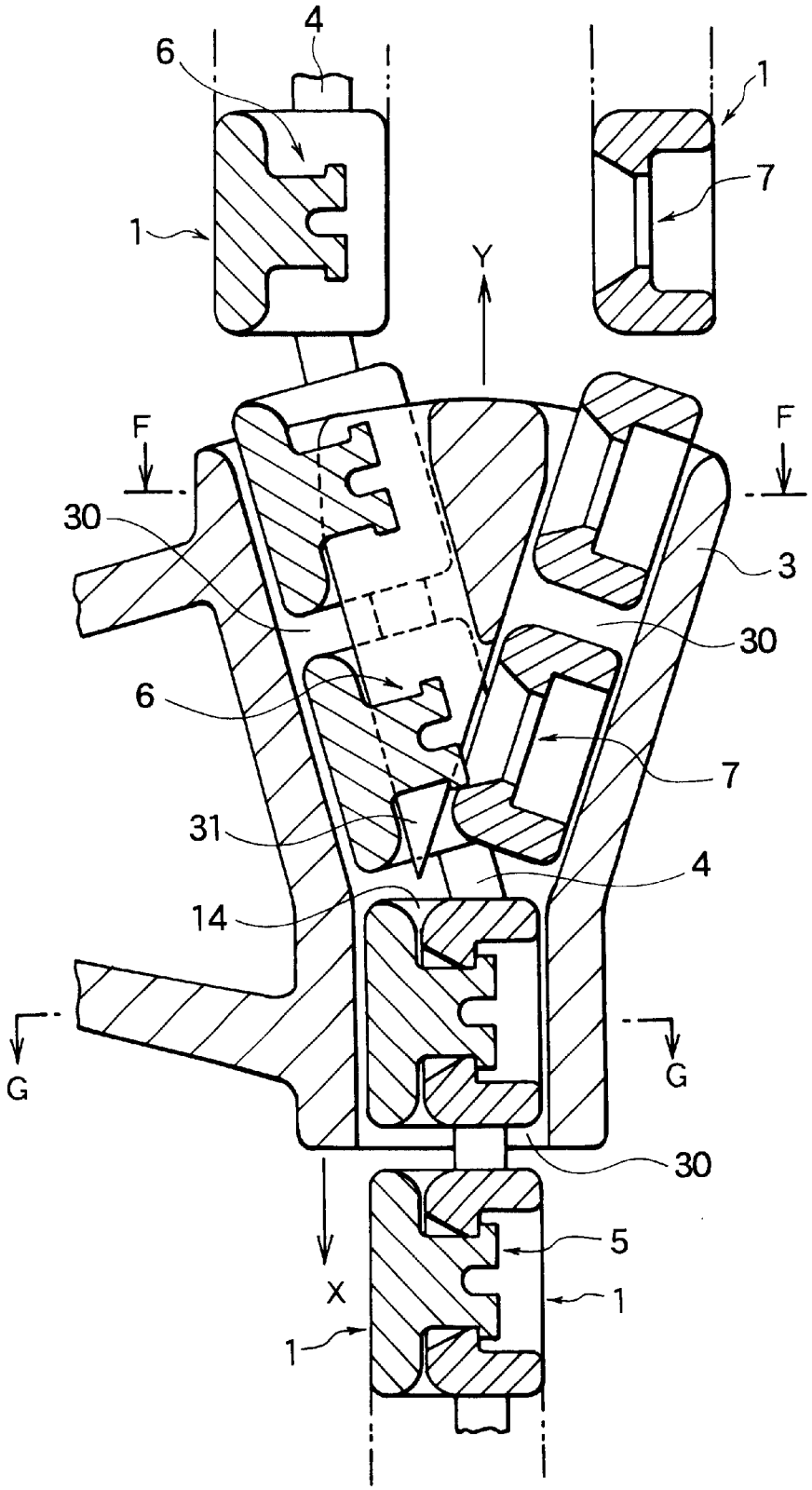
FIG. 8 is a sectional view of the slide fastener taken along a line E—E in FIG. 1.
Figure 9:
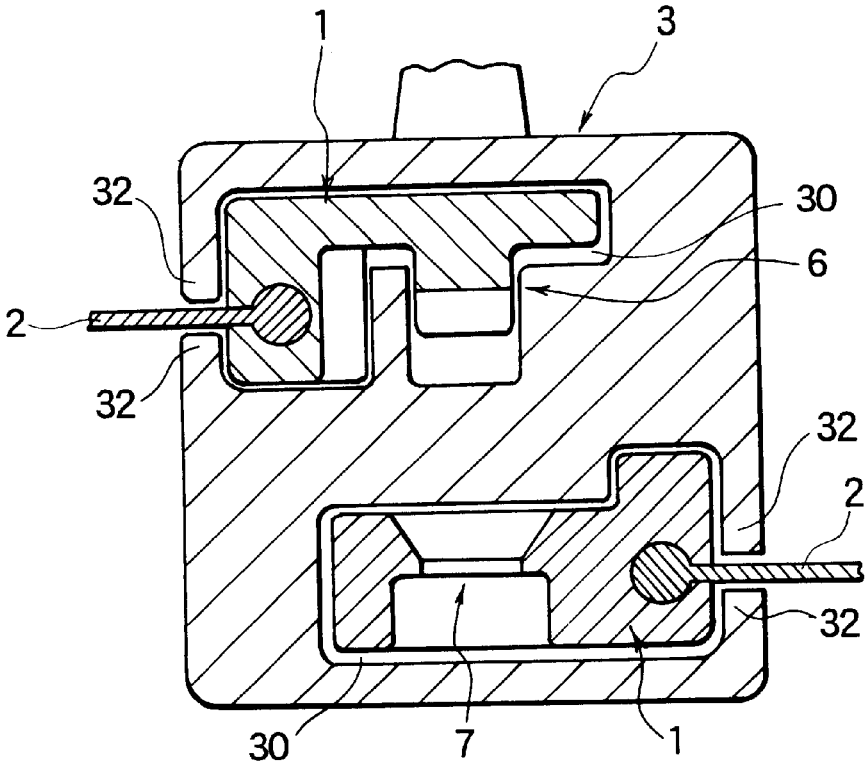
FIG. 9 is a sectional view of the slide fastener taken along a line F—F in FIG. 8.
Figure 10:
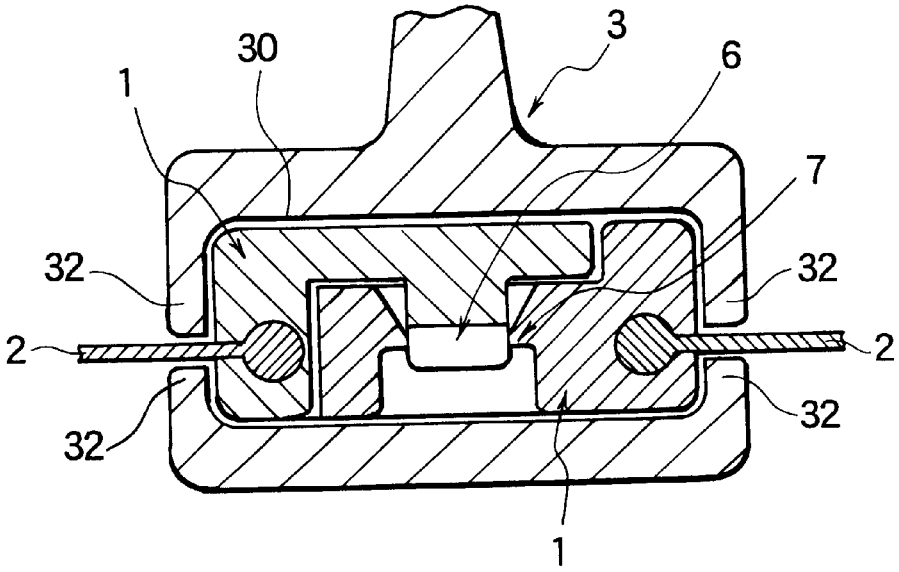
FIG. 10 is a sectional view of the slide fastener taken along a line G—G in FIG. 8.

By using the slider 3, the engaging elements 1, 1 mounted to the right and left fastener tapes 2, 2 are placed with one upon another from above and below and are engaged with each other by fitting the engaging male portion 6 into the engaging female portion 7. At the time of this engagement, because the engaging head 10 is bulging only in longitudinal directions, the engaging head 10 is engaged in a state wherein the engaging head is inclined with respect to a longitudinal direction of the fastener chain, i.e., in a state as shown in FIG. 8, for example. Because simultaneous engagement on opposite sides of the engaging head 10 are not necessary, and thus, the engaging elements 1, 1 can be extremely easily engaged with each other.

The guide portion 31 is formed horizontally in the slider 3 for separating and opening the engaging elements 1, 1. Therefore, by sliding the slider 3 in a direction shown by an arrow X in FIG. 8, the guide portion 31 is inserted into the wedge-shaped gap portion 14 between the upper and lower engaged engaging elements 1, 1, thereby separating the engaging elements 1, 1 from each other in upward and downward directions. Also, by sliding the slider 3 in a direction shown by an arrow Y in FIG. 8, the engaging male portion 6 and the engaging female portion 7 of the upper and lower separated engaging elements 1, 1 are fitted and engaged with each other, thereby closing the fastener chain. Even if right and left tensile loads are applied to the fastener chain, because an engaging contact point between the engaged engaging elements 1, 1 and the right and left fastener tapes 2, 2 are in the same horizontal plane, rotation moment is not generated in the engaging elements 1, 1, and thus, the engaging elements 1, 1 are not displaced due to rotation or falling.

Figure 11:
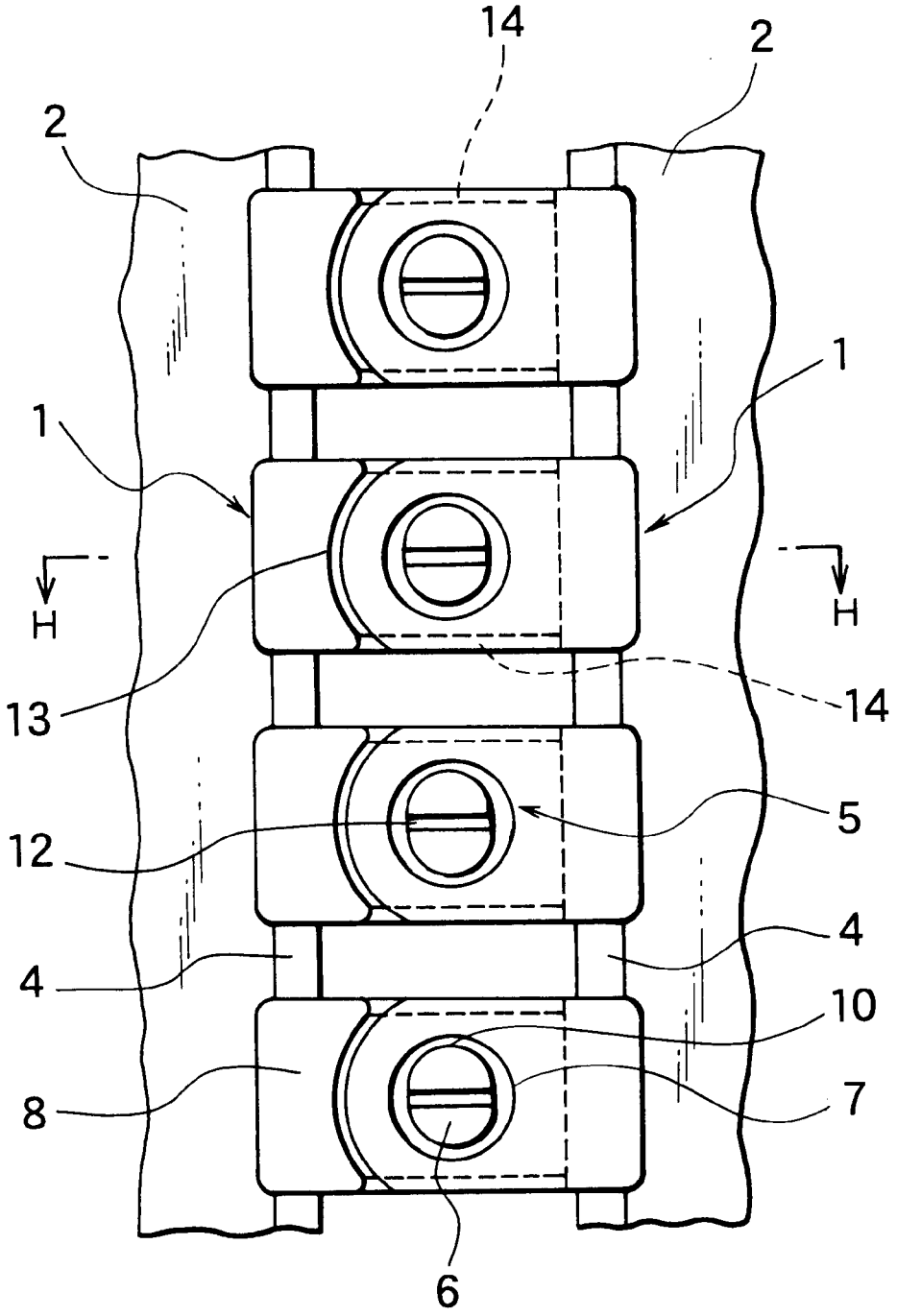
FIG. 11 is a rear view of an essential portion of a second embodiment of the slide fastener.
Figure 12:
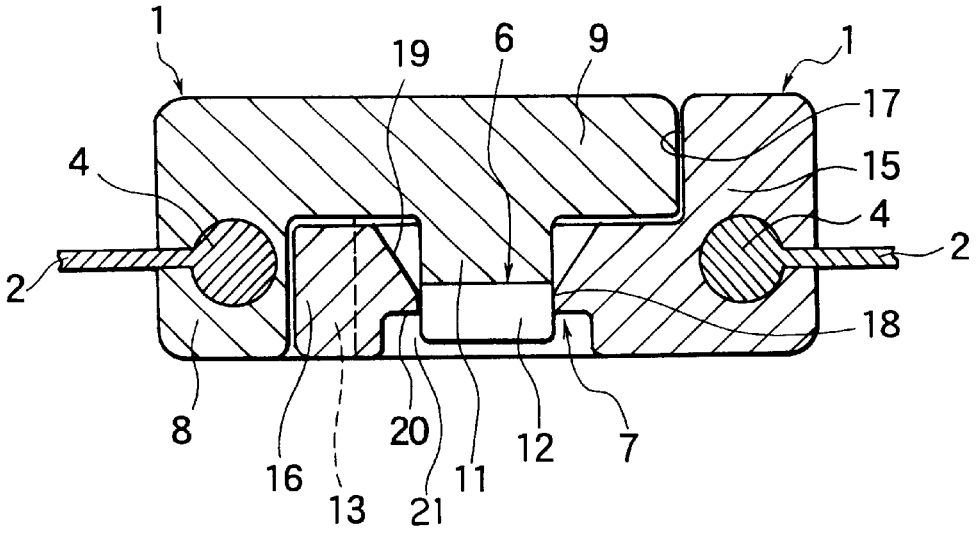
FIG. 12 is a sectional view of the slide fastener taken along a line H—H in FIG. 11.

In a second embodiment of the slide fastener shown in FIGS. 11 and 12, a pair of engaging elements 1, 1 respectively comprise flat engaging tongues 9 and 16 which project from tape mounting portions 8 and 15 and have the same thickness. The engaging elements 1, 1 are substantially L-shaped in section. The right and left fastener tapes 2, 2 are mounted to the tape mounting portions 8 and 15 at positions deviated to lower sides of the mounting portions 8 and 15. An engaging male portion 6 as an engaging portion 5 is formed at a center of a lower face of the engaging tongue 9 of the upper engaging element 1. The engaging male portion 6 has a bulging engaging head 10 bulging in longitudinal directions from a tip end of a column 11 at a position deviated downward from a plane of the fastener tape 2 mounted to the tape mounting portion 8. The engaging head 10 is defined in a top face thereof with a U-shaped recessed groove 12 which is carved laterally to be deeper than a disposing position of the engaging head 10, thereby providing resilience to the engaging head 10. A lower and inner wall face of the tape mounting portion 8 is formed into an arc-shaped vertical fitting face 13 such that an arc-shaped tip end of the engaging tongue 16 of the opposite engaging element 1 can be received by and abut on the fitting face 13.

In the other lower one engaging element 1, an engaging hole 18 into which the engaging male portion 6 can be fitted and which has substantially the same diameter as the column 11 is defined at a center of the engaging tongue 16 projecting from the tape mounting portion 15, thereby forming an engaging female portion 7. The engaging female portion 7 is a circular through hole and has a tapered face 19 with its peripheral edge being expanded toward an entrance. A lock portion 20 with its peripheral edge projecting toward a center of the engaging female portion 7 is formed at a position below the tapered face 19 and lower than the plane of the fastener tapes 2, thereby forming an engaging recessed portion 21 to be engaged with the engaging head 10 of the engaging male portion 6. An upper inner wall face of the tape mounting portion 15 is formed into a vertical fitting face 17 so as to abut on a tip end of a vertical face of the engaging tongue 9 of the opposite engaging element 1. A tip end of the engaging tongue 16 is formed into an arc shape so as to abut on and to be received by the arc-shaped fitting face 13 of the opposite engaging element 1.

Furthermore, top and bottom engaging end faces of the engaging tongues 9 and 16 of the pair of engaging elements 1, 1 in a longitudinal direction of the fastener chain are chamfered into arc shapes so as to form a wedge-shaped gap portion 14 between the engaging elements 1, 1, thereby facilitating insertion of the guide portion 31 of the slider 3 between the engaging elements 1, 1. Because an engaging contact point between the engaging portions 5 of the pair of engaged engaging elements 1, 1 exists below the plane of the right and left fastener tapes 2, 2, even though rotation moment acts on the engaging elements 1 when right and left tensile loads are applied, the arc-shaped fitting face 13 formed in the upper engaging element 1 abuts on the arc-shaped tip end of the engaging tongue 16 of the lower engaging element 1, thereby previously preventing displacement due to rotation of the engaged right and left engaging elements 1, 1 and horizontal states of the pair of engaging elements 1, 1 can be maintained.

Figure 13:
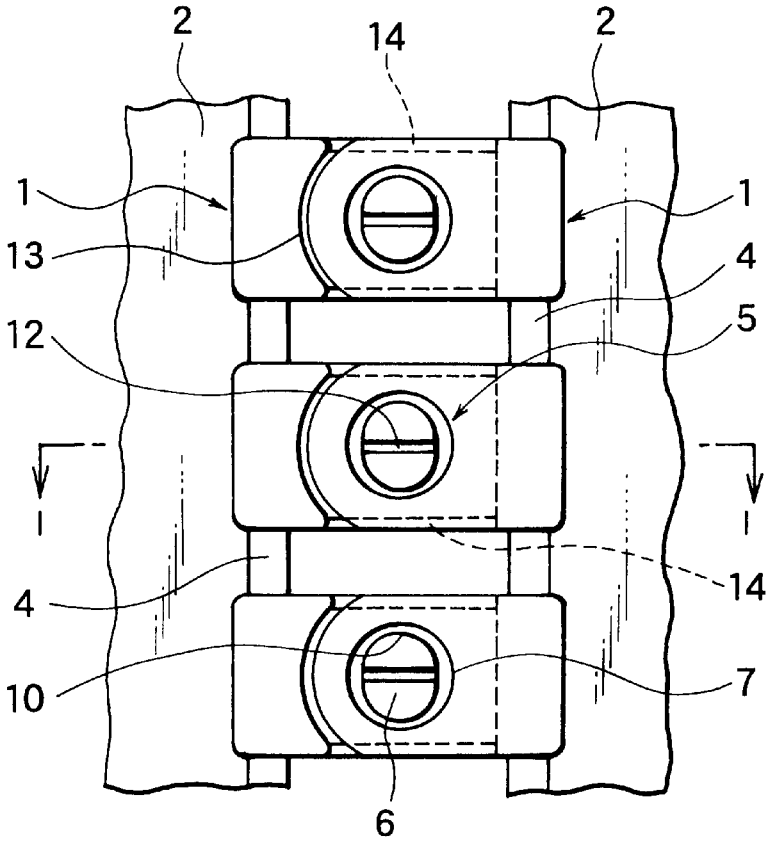
FIG. 13 is a rear view of an essential portion of a third embodiment of the slide fastener.
Figure 14:
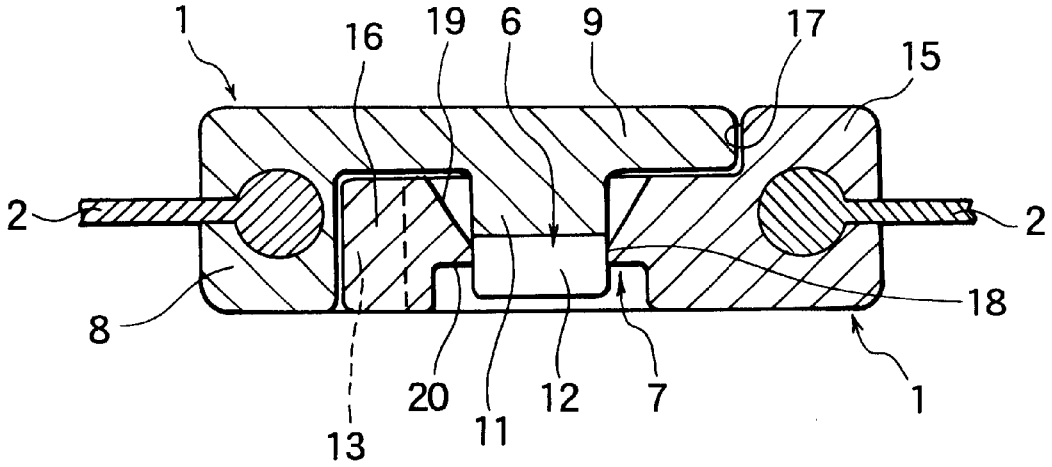
FIG. 14 is a sectional view of the slide fastener taken along a line I—I in FIG. 13.

A third embodiment of the slide fastener shown in FIGS. 13 and 14 is different from the second embodiment in that the tape mounting portion 8 and the engaging tongue 9 of the upper engaging element 1 having the engaging male portion 6 are formed to be thinner than those of the second embodiment and that the tape mounting portion 15 of the lower engaging element 1 having the engaging female portion 7 is formed to be thin such that the slide fastener is formed to be thin. The third embodiment is similar to the second embodiment except for the above differences. Also, the third embodiment has a similar engaging operation to that of the second embodiment. Because an engaging contact point between the opposed engaging elements 1, 1 exists below a plane of the right and left fastener tapes 2, 2, even though rotation moment acts on the engaging elements 1 when right and left tensile loads are applied, the fitting face 13 formed in the upper engaging element 1 abuts on the tip end of the engaging tongue 16 of the lower engaging element 1, thereby previously preventing displacement due to rotation of the engaged engaging elements 1, 1 and horizontal states of the pair of engaging elements 1, 1 can be maintained.

Figure 15:
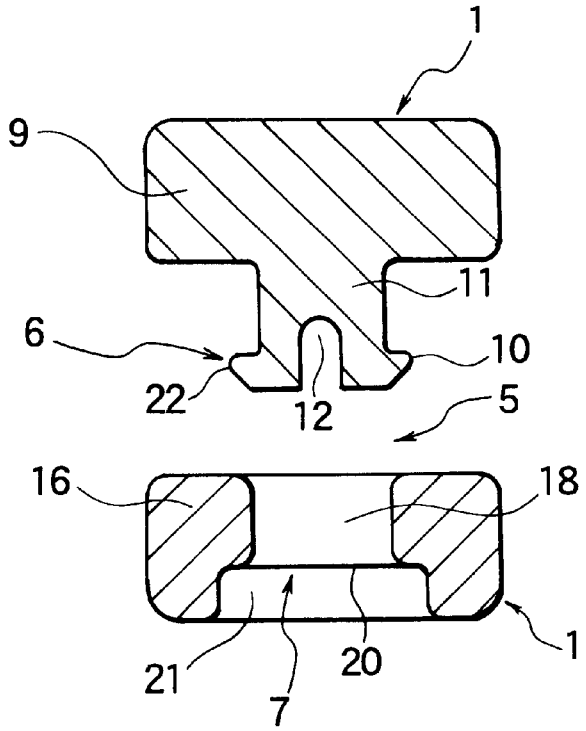
FIG. 15 is a cross-sectional view of an engaging element of a fourth embodiment of the slide fastener.

A fourth embodiment of the slide fastener shown in FIG. 15 is a modification of the engaging portions 5 disposed in the engaging elements 1. In the engaging male portion 6, an engaging head 10 projects from a tip end of a column 11 only in longitudinal directions. The engaging head 10 is chamfered in a tapered manner to form a tapered face 22, thereby facilitating engagement of the engaging male portion 6 with the engaging female portion 7. A U-shaped recessed groove 12 which is deeper than a disposing position of the engaging head 10 is laterally carved in the engaging head 10, thereby providing resilience to the engaging head 10.

On the other hand, the engaging female portion 7 is defined with an engaging hole 18 having substantially the same diameter as that of the column 11 of the engaging male portion 6. An engaging recessed portion 21 in such a size that the engaging head 10 can be fitted into the engaging recessed portion 21 is defined at a tip end of the engaging hole 18. A right-angled step is defined between the engaging hole 18 and the engaging recessed portion 21, thereby forming a lock portion 20 to be engaged with the engaging head 10. The fourth embodiment is substantially the same as the above embodiments except for the above features of the engaging elements 1. By the engaging elements 1, 1 of this embodiment, the engaging elements 1, 1 can be firmly engaged with each other without play therebetween.

Figure 16:
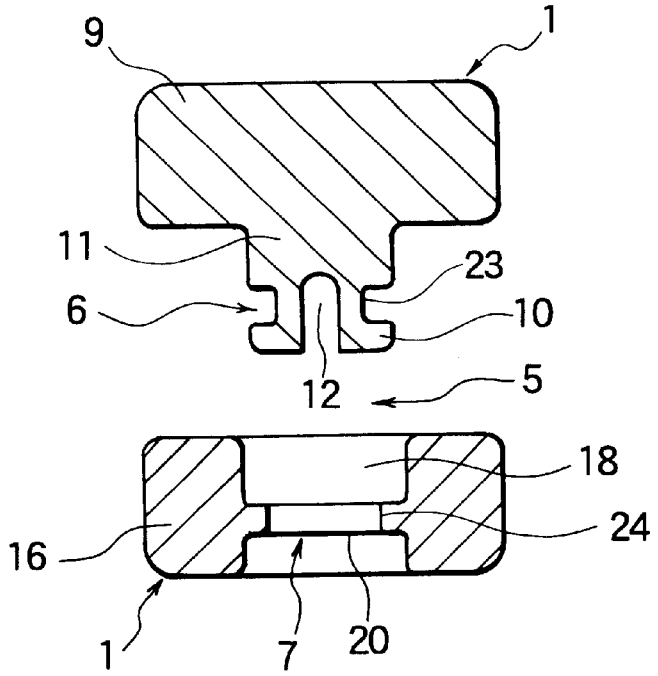
FIG. 16 is a cross-sectional view of an engaging element of a fifth embodiment of the slide fastener.
Figure 17:
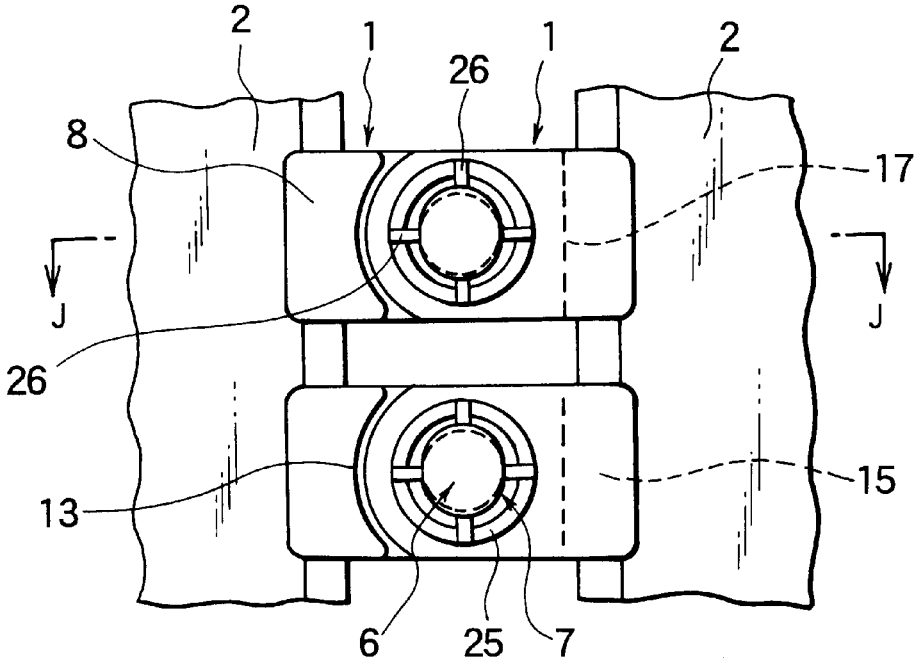
FIG. 17 is a rear view of an essential portion of a sixth embodiment of the slide fastener.
Figure 18:
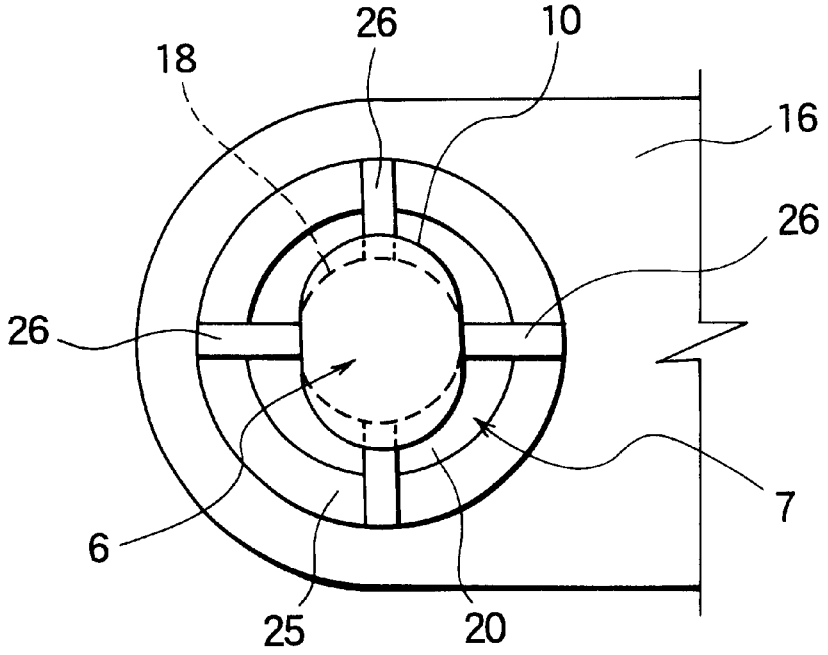
FIG. 18 is a rear view of an engaging portion of the engaging elements of the slide fastener.
Figure 19:
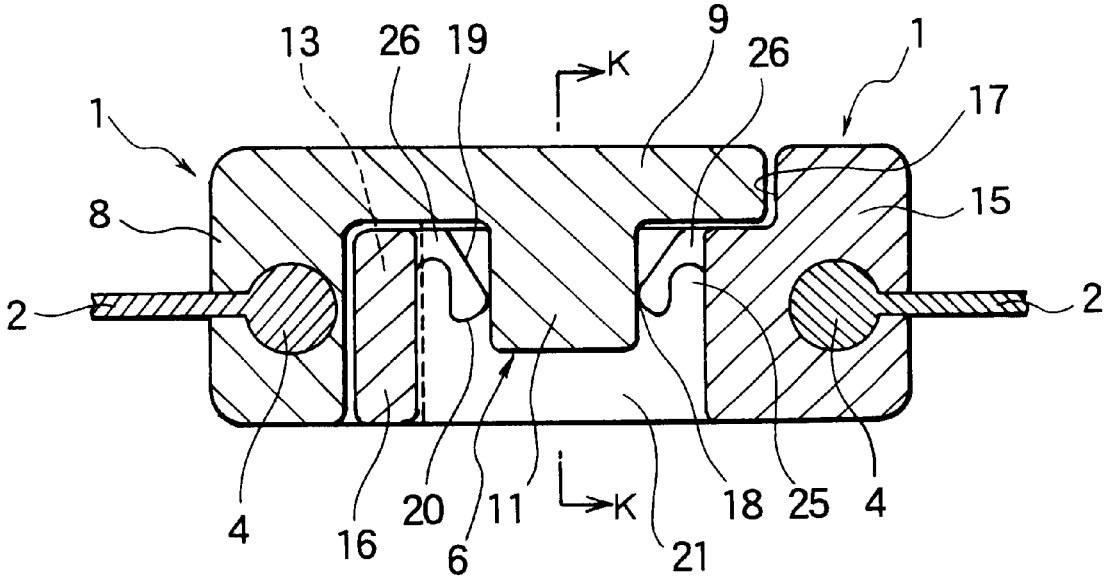
FIG. 19 is a sectional view of the slide fastener taken along a line J—J in FIG. 17.
Figure 20:
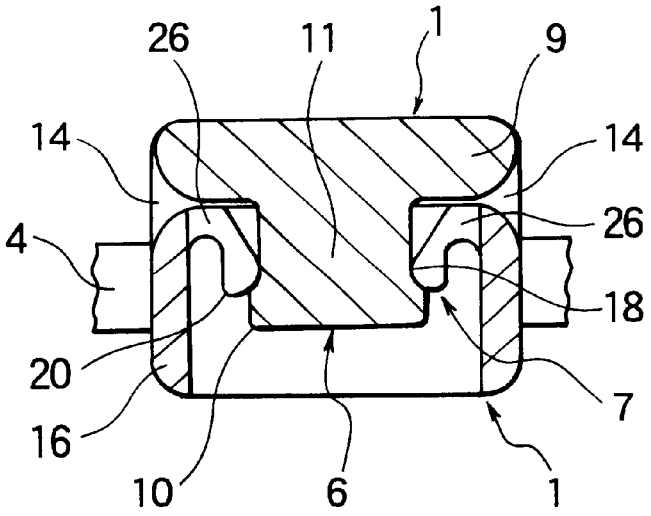
FIG. 20 is a sectional view of the slide fastener taken along a line K—K in FIG. 19.
Figure 21:
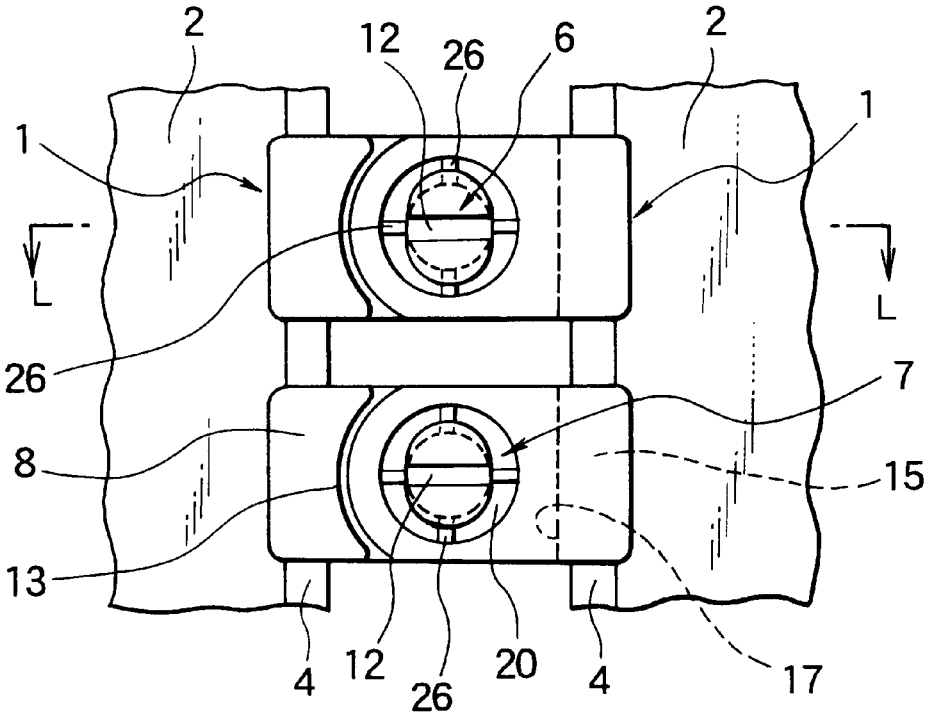
FIG. 21 is a rear view of an essential portion of a seventh embodiment of the slide fastener.
Figure 22:
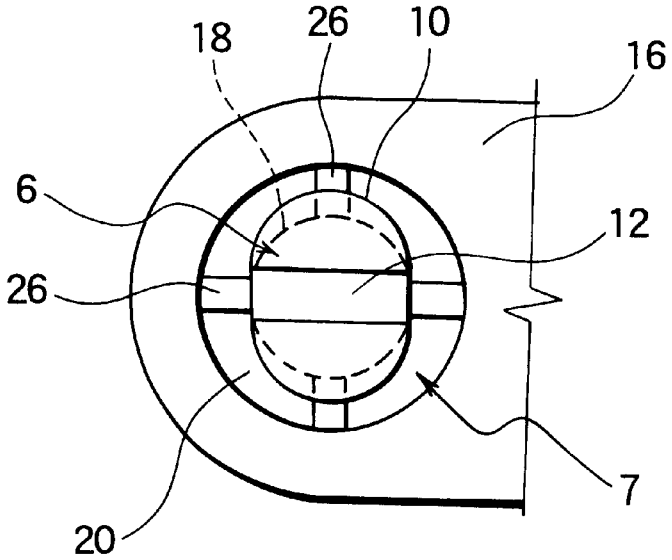
FIG. 22 is a rear view of an engaging portion of the engaging element of the slide fastener.
Figure 23:
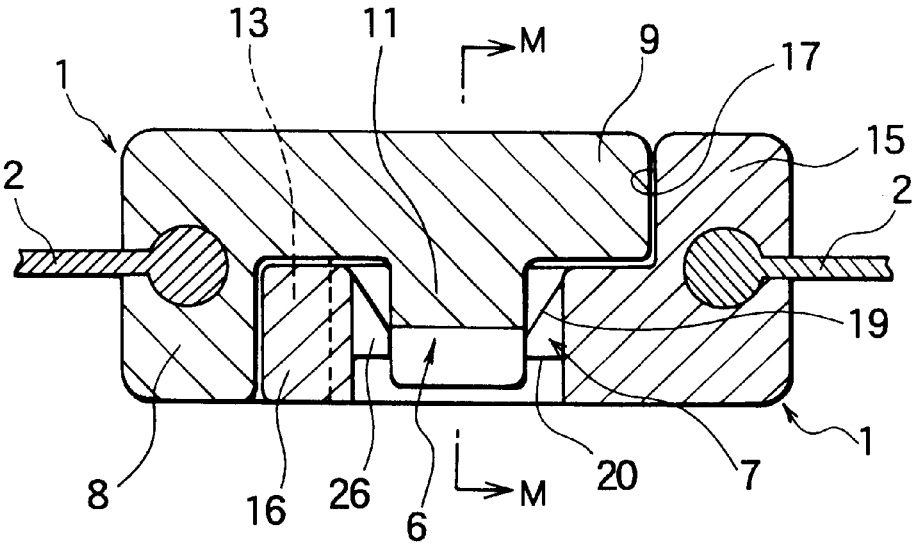
FIG. 23 is a sectional view of the slide fastener taken along a line L—L in FIG. 21.
Figure 24:
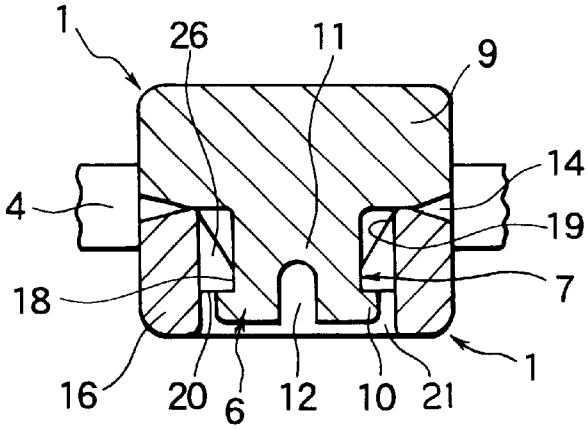
FIG. 24 is a sectional view of the slide fastener taken along a line M—M in FIG. 23.

A fifth embodiment of the slide fastener shown in FIG. 16 is a modification of the engaging portions 5 disposed in the engaging elements 1. In the engaging male portion 6, lock recessed portions 23 are formed by notching top and bottom portions of the column 11 near the tip end of the column 11 in recessed shapes, thereby forming engaging head 10 which bulges in the longitudinal directions from the tip end of the column 11. A U-shaped recessed groove 12 deeper than a disposing position of the lock recessed portion 23 is laterally carved in the tip end of the column 11, thereby providing resilience to the engaging head 10.

On the other hand, the engaging female portion 7 is defined with an engaging hole 18 having substantially the same diameter as that of the column 11 of the engaging male portion 6. A lock projecting portion 24 projecting toward a center of the engaging hole 18 is formed at a midway position of the engaging hole 18, thereby forming a lock portion 20. The fifth embodiment is substantially the same as the above embodiments except for the above engaging portions 5. By the engaging elements 1, 1 of this embodiment, the engaging elements 1, 1 can be firmly engaged with each other without play therebetween.

In a sixth embodiment of the slide fastener shown in FIGS. 17 to 20, engaging elements 1, 1 having substantially L shapes in section are mounted on core portions 4 of the right and left fastener tapes 2, 2 and the engaging elements 1, 1 are placed with one upon another while holding each other. A column 11 is formed to project from a center of a lower face of the engaging tongue 9 of the upper engaging element 1. An engaging head 10 bulges in longitudinal directions from the tip end of the column 11 at a position in a plane of the fastener tapes 2 mounted to the tape mounting portions 8, thereby forming the engaging male portion 6. The engaging male portion 6 is solid and can not be resiliently deformed. An inner face of the tape mounting portion 8 is formed into an arc-shaped fitting face 13.

On the other hand, an engaging hole 18 with substantially the same diameter as that of the column 11 is defined at a center of the engaging tongue 16 of the lower engaging element 1. A tapered face 19 is formed on an entrance side of the engaging hole 18. A lock portion 20 projecting toward a center of the engaging hole 18 is formed at a lower portion of the tapered face 19 in a plane wherein the fastener tape 2 mounted to the tape mounting portion 15 exists. An engaging recessed portion 21 is formed below the lock portion 20 and a groove 25 having a U shape in section and adjacent to the lock portion 20 is defined to surround the lock portion 20, thereby applying resilience to the lock portion 20. Upper and lower slits 26 are formed at several positions on a peripheral edge of the lock portion 20, thereby enabling the lock portion 20 to be further easily deformed resiliently. A tip end of the engaging tongue 16 is formed into an arc shape similarly to the above embodiments such that the tip end can abut on and can be received by the arc-shaped fitting face 13 of the mating engaging element 1. In this manner, the slide fastener is formed such that the engaging male portion 6 and the engaging female portion 7 can be easily engaged with each other.

In a seventh embodiment of the slide fastener shown in FIGS. 21 to 24, a pair of engaging elements 1, 1 have the engaging tongues 9 and 16 with the same thickness and projecting in flat shapes from the tape engaging portions 8 and 15 and have substantially L shapes in section. The fastener tapes 2, 2 are attached to centers of the thick tape mounting portions 8 and 15. A column 11 is formed to project from a center of a lower face of the engaging tongue 9 of the upper engaging element 1. A bulging engaging head 10 projecting in longitudinal directions from a tip end of the column 11 is formed at a position of the column 11 deviated downward from a plane of the fastener tape 2. A U-shaped recessed groove 12 is defined in a top face of the engaging head 10, thereby forming the engaging male portion 6 which can be resiliently deformed. An inner wall face of the tape mounting portion 8 is formed into an arc-shaped fitting face 13 for receiving a tip end of the engaging tongue 16 of the mating engaging element 1.

In the lower engaging element 1, an engaging hole 18 with substantially the same diameter as that of the column 11 is defined at a center of the engaging tongue 16. A peripheral edge of the engaging hole 18 at an entrance thereof is expanded to form a tapered face 19. The peripheral edge projects toward a center of the engaging hole 18 at a position deviated downward from a plane of the fastener tape 2 attached to the tape mounting portion 15 so as to form a lock portion 20, thereby forming an engaging recessed portion 21 to be engaged with the engaging head 10 of the engaging male portion 6. Upper and lower several slits 26 are formed from an upper side to a lower side of the engaging tongue 16 to extend from the tapered face 19 to the lock portion 20, thereby providing resilience to the engaging female portion 7. By providing resilience to the engaging male portion 6 and the engaging female portion 7, an engaging operation can be carried out extremely easily. Further, because a tip end of the engaging portion 16 is formed into an arc shape so as to abut on and to be received by the fitting face 13 of the mating engaging element 1, the pair of engaging elements 1, 1 are not displaced due to rotation, even if right and left tensile loads are applied to and rotation moment acts on the engaging elements 1, 1.

Figure 25:
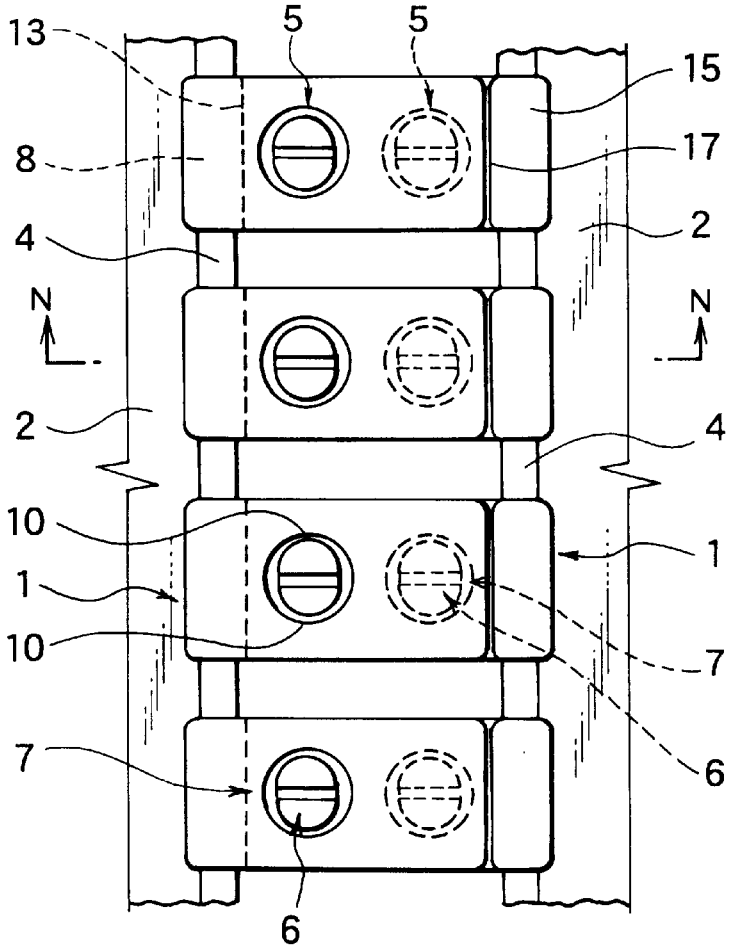
FIG. 25 is a front view of an essential portion of an eighth embodiment of the slide fastener.
Figure 26:
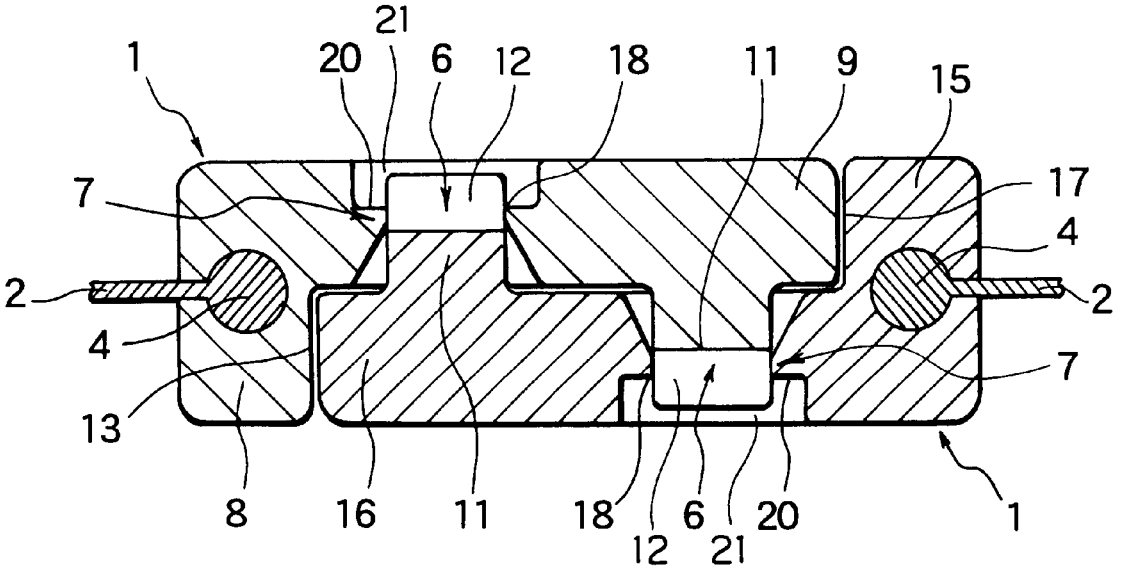
FIG. 26 is a sectional view of the slide fastener taken along a line N—N in FIG. 25.
Figure 27:
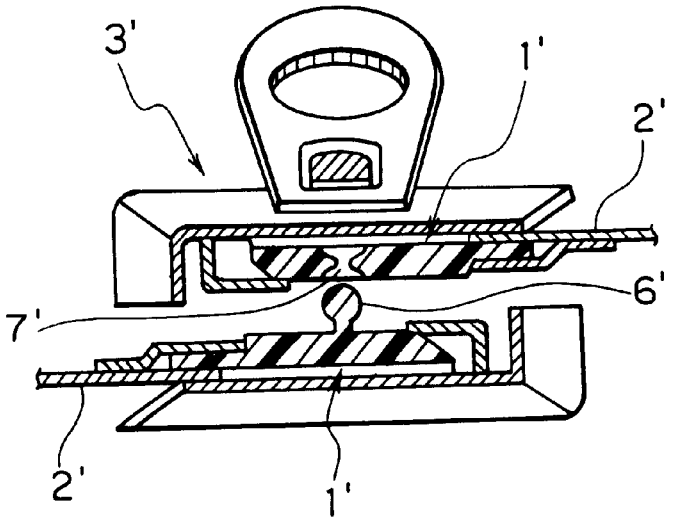
FIG. 27 (PRIOR ART)
FIG. 27 is a cross-sectional view of a known slide fastener.

In an eighth embodiment of the slide fastener shown in FIGS. 25 and 26, symmetrical engaging elements 1 which are substantially L-shaped in section and have large widths are mounted to core portions 4 of the right and left fastener tapes 2, 2 with one element placed upon another while holding each other, and the engaging male portion 6 and the engaging female portion 7 as engaging portions 5 are engaged with each other. The fastener tapes 2, 2 are attached to the upper and lower engaging elements 1, 1 at centers of thick tape mounting portions 8 and 15, respectively. Flat engaging tongues 9 and 16 are respectively formed to project from one side of each of the tape mounting portions 8 and 15. An engaging hole 18 having a tapered face 19 and an engaging recessed portion 21 are formed at a base portion of each of the engaging tongues 9 and 16. A column 11 is formed to project from an opposed face on a tip end side of each of the engaging tongues 9 and 16 and a bulging engaging head 10 is formed to project in longitudinal directions from the tip end of the column 11. A U-shaped recessed groove 12 is carved in a top face of each the engaging head 10 to be deeper than a disposing position of the engaging head 10, thereby providing resilience to the engaging head 10.

Inner wall faces of the tape mounting portions 8 and 15 are respectively formed into vertical and flat fitting faces 13 and 17. Tip ends of the engaging tongues 9 and 16 are formed into vertical faces. When the engaging elements 1, 1 are placed with one upon another, the tip ends which are the vertical faces of the engaging tongues 16 and 9 abut on the fitting faces 13 and 17 which are the vertical flat faces. Therefore, the engaging elements 1, 1 are symmetric and are not displaced due to rotation or falling when right and left tensile loads are applied.

As can be understood from the descriptions of the eight embodiments of the slide fastener, because the engaging elements 1 are symmetric, it is unnecessary to distinguish the upper and lower engaging elements 1 from each other, and it is possible to mount the engaging element 1 to one fastener tape 2 and to use a pair of such engaging elements 1 facing each other. Therefore, the slide fastener can be manufactured extremely easily.

The slide fastener of the invention has the above-described structure and exhibits the following effects with the structure.

With the slide fastener of the invention which includes the engaging elements 1 to be engaged with and disengaged from each other in upward and downward directions and which are disposed on the pair of fastener tapes 2 at constant intervals, and the slider including the guide portion 31 formed laterally, and the right and left fastener tapes 2 to which the opposed engaging elements 1 are mounted are disposed in the same plane, and the opposed engaging elements 1 are formed into such shapes that the engaging elements 1 can not be displaced as a result of rotation due to right and left tensile loads applied in engagement of the engaging elements 1. Therefore, the opposed engaging elements 1 are previously prevented from being displaced as a result of falling or rotating when the right and left tensile loads are applied to the opposed engaging elements 1. As a result, there is no problem of canceling of engagement of the engaged engaging elements 1, regular engaging state can be maintained, and the slide fastener is presentable. Also, because the engaging elements 1 are engaged with each other in a vertical direction, the engagement is resistant to lateral pulling, thereby providing the strong slide fastener.

As the engaging contact point between the engaging male portion 6 and the engaging female portion 7 of the engaging portion 5 of the opposed engaging elements 1 is in a plane where the right and left fastener tapes 2 exist, the rotation moment due to the right and left tensile loads does not act on the engaged engaging elements 1 and the engaging elements 1 are not displaced due to falling or rotation likely in a conventional slide fastener by the simple structures. Therefore, there is no problem of canceling of the engagement of the engaging elements 1, thereby providing the slide fastener with excellent quality and function.

As the fitting faces 13, 17 which can abut on the tip ends of the opposed engaging elements 1 are formed in vicinity of the tape mounting portions 8, 15 of the opposed engaging elements 1, and thus, the opposed engaging elements 1 are formed such that the engaging elements 1 are not displaced due to falling or rotation with the simple structures of the engaging elements 1 even if the rotation moment acts on the engaged engaging elements 1 as a result of right and left tensile loads. Therefore, there is no problem of canceling of the engagement of the engaging elements 1, thereby providing the slide fastener with excellent quality and function.

Further in this invention, the opposed engaging elements 1 have substantially L shapes in section in the lateral direction, the engaging elements 1 are defined at one ends thereof to be the thick tape mounting portions 8, 15 and at the other ends thereof to be the flat engaging tongues 9, 16 projecting from the tape mounting portions 8, 15, the engaging elements 1 are placed with one upon another while holding each other, the engaging male portion 6 is formed to project from one of the opposed faces of the elements 1, the engaging female portion 7 is defined to be recessed in the other of the opposed faces, and the engaging contact point of the engaging portion 5 is in the plane where the right and left fastener tapes 2 exist. Because the engaged engaging elements 1 hold each other and the engaging contact point is in the plane of the fastener tapes 2, the engaging elements 1 are previously prevented from being displaced due to falling or rotation. Also, because end portions of the engaged engaging elements 1 are not exposed and are not caught on other articles, there is no problem of canceling of the engagement of the engaging elements 1.

And in this invention, the opposed engaging elements 1 have substantially L shapes in section, the engaging elements 1 are defined at one ends thereof to be the thick tape mounting portions 8, 15 and at the other ends thereof to be the flat engaging tongues 9, 16 projecting from the tape mounting portions 8, 15, the engaging elements 1 are placed with one upon another while holding each other, the engaging male portion 6 is formed to project from one of the opposed faces, the engaging female portion 7 is defined to be recessed in the other of the opposed faces, and the fitting faces 13, 17 are formed in the vicinity of the tape mounting portions 8, 15. Because the engaged engaging elements 1 hold each other and the tip ends of the engaging portions 5 abut on and are engaged with the fitting faces 13, 17, the engaging elements 1 are previously prevented from being displaced due to falling or rotation. Also, because the end portions of the engaged engaging elements 1 are not exposed and are not caught on other articles, there is no problem of canceling of the engagement of the engaging elements 1.

Further, the engaging contact point between the opposed engaging elements 1 is disposed at a position deviated downward from the plane where the fastener tapes 2 exist, and the arc-shaped fitting face 13 for receiving the arc-shaped tip end of the engaging tongue 16 of the lower engaging element 1 is formed in the upper engaging element 1. Therefore, the engagement of the engaging elements 1 is flexibly protected on the rear face side. Also, because the engaging elements 1 can be formed to be thin, the presentable slide fastener can be obtained.

In this invention, one of the engaging male portion 6 and the engaging female portion 7 of the engaging portion 5 can be resiliently deformed, thereby engaging the engaging male portion 6 and the engaging female portion 7 with each other, or both the engaging male portion 6 and the engaging female portion 7 can be resiliently deformed, thereby engaging the engaging male portion 6 and the engaging female portion 7 with each other. Therefore, the engagement and disengagement operations of the engaging elements 1 with and from each other can be carried out easily and reliably.

Further, the bulging engaging head 10 formed at the engaging male portion 6 of the engaging element 1 projects only in the longitudinal directions. Because the engagement of the engaging elements 1 is only in one direction, the engagement and disengagement operations of the engaging elements 1 are easy, and thus, the sliding operation of the slider 3 can be carried out smoothly.

In this invention, a plurality of engaging portions 5 each having the engaging male portion 6 and the engaging female portion 7 are symmetrically disposed on the opposed engaging elements 1. Therefore, because the engaging element 1 mounted to one fastener tape 2 can be used as the right and left opposed engaging elements 1, the slide fastener can be manufactured extremely easily.

Further, in this invention, the wedge-shaped gap portion 14 is defined at least at the front end of the engaged opposed engaging elements 1, and the acute-angled guide portion 31 of the slider 3 is formed to be inserted into the gap portion 14. Because the guide portion 1 of the slider 3 can be easily inserted into the gap portion 14 of the engaged engaging elements 1 to separate the engaging elements 1, the opening operation of the fastener chain by the slider 3 can be carried out extremely smoothly. As described above, the effects of the present invention are extremely remarkable.

What is claimed:

1. A slide fastener comprising:

(a) a plurality of engaging elements disposed on edge portions of first and second fastener tapes, the engaging elements on the first fastener tape having an engaging male portion projecting perpendicularly to a plane of the first fastener tape, the engaging elements on the second fastener tape having an engaging female portion engageable with the engaging male portion; and (b) a slider having a guide portion positioned adjacent to the engaging elements being engaged with and disengaged from each other;

wherein the first and second fastener tapes having the engaging elements are substantially coplanar.

2. A slide fastener according to claim 1, wherein an engaging contact point between the engaging male portion and the engaging female portion of opposed engaging elements is in a plane where the first and second fastener tapes exist.

3. A slide fastener according to claim 1, wherein fitting faces which can abut on tip ends of opposed engaging elements are formed in vicinity of tape mounting portions of the opposed engaging elements.

4. A slide fastener according to claim 2, wherein the opposed engaging elements have substantially L shapes in section in a lateral direction of a fastener chain, the engaging elements are defined at one end thereof to be thick tape mounting portions and at another end thereof to be flat engaging tongues projecting from the tape mounting portions, the engaging elements are placed with one upon another while holding each other, the engaging male portion is formed to project from one of opposed faces of the elements, the engaging female portion is defined to be recessed in another of said opposed faces, and the engaging contact point is in the plane where the first and second fastener tapes exist.

5. A slide fastener according to claim 3, wherein the opposed engaging elements have substantially L shapes in section in a lateral direction of a fastener chain, the engaging elements are defined at one end thereof to be thick tape mounting portions and at another end thereof to be flat engaging tongues projecting from the tape mounting portions, the engaging elements are placed with one upon another while holding each other, the engaging male portion is formed to project from one of opposed faces of the elements, the engaging female portion is defined to be recessed in another of the opposed faces, and the fitting faces are formed in the vicinity of the tape mounting portions.

6. A slide fastener according to claim 3, wherein an engaging contact point between the opposed engaging elements is disposed at a position deviated downward from the plane where the fastener tapes exist, and an arc-shaped fitting face for receiving an arc-shaped tip end of an engaging tongue of one engaging element is formed in another engaging element.

7. A slide fastener according to any one of claims 1 to 6, wherein the engaging male portion of the engaging elements is formed into a bulging engaging head which can be resiliently deformed, and the engaging female portion is formed into a through hole-shaped engaging hole which can not be deformed.

8. A slide fastener according to any one of claims 1 to 6, wherein the engaging male portion of the engaging elements is formed into a bulging engaging head which can not be deformed, and the engaging female portion is formed into a through hole-shaped engaging hole which can be resiliently deformed.

9. A slide fastener according to any one of claims 1 to 6, wherein the engaging male portion of the engaging elements is formed into a bulging engaging head which can be resiliently deformed, and the engaging female portion is formed into a through hole-shaped engaging hole which can be resiliently deformed.

10. A slide fastener according to claim 7, wherein the bulging engaging head defined in the engaging male portion of the engaging element projects only in longitudinal directions of the engaging element.

11. A slide fastener according to any one of claims 1 to 6, wherein a plurality of engaging portions each having the engaging male portion and the engaging female portion are symmetrically disposed on the opposed engaging elements.

12. A slide fastener according to any one of claims 1 to 6, wherein a wedge-shaped gap portion is defined at least at a front end of the engaged opposed engaging elements, and the guide portion having an acute angle of the slider is formed to be inserted into the gap portion.

13. A slide fastener according to claim 5, wherein an engaging contact point between the opposed engaging elements is disposed at a position deviated downward from the plane where the fastener tapes exist, and an arc-shaped fitting face for receiving an arc-shaped tip end of an engaging tongue of one engaging element is formed in another engaging element.

14. A slide fastener according to claim 13, wherein the engaging male portion of the engaging elements is formed into a bulging engaging head which can be resiliently deformed, and the engaging female portion is formed into a through hole-shaped engaging hole which cannot be deformed.

15. A slide fastener according to claim 13, wherein the engaging male portion of the engaging elements is formed into a bulging engaging head which cannot be deformed, and the engaging female portion is formed into a through hole-shaped engaging hole which can be resiliently deformed.

16. A slide fastener according to claim 13, wherein the engaging male portion of the engaging elements is formed into a bulging engaging head which can be resiliently deformed, and the engaging female portion is formed into a through hole-shaped engaging hole which can be resiliently deformed.

17. A slide fastener according to claim 14, wherein the bulging engaging head defined in the engaging male portion of the engaging element projects only in longitudinal directions of the engaging element.

18. A slide fastener according to claim 15, wherein the bulging engaging head defined in the engaging male portion of the engaging element projects only in longitudinal directions of the engaging element.

19. A slide fastener according to claim 16, wherein the bulging engaging head defined in the engaging male portion of the engaging element projects only in longitudinal directions of the engaging element.

20. A slide fastener according to claim 8, wherein the bulging engaging head defined in the engaging male portion of the engaging element projects only in longitudinal directions of the engaging element.

21. A slide fastener according to claim 9, wherein the bulging engaging head defined in the engaging male portion of the engaging element projects only in longitudinal directions of the engaging element.

22. A slide fastener according to claim 7, wherein a plurality of engaging portions each having the engaging male portion and the engaging female portion are symmetrically disposed on the opposed engaging elements.

23. A slide fastener according to claim 8, wherein a plurality of engaging portions each having the engaging male portion and the engaging female portion are symmetrically disposed on the opposed engaging elements.

24. A slide fastener according to claim 9, wherein a plurality of engaging portions each having the engaging male portion and the engaging female portion are symmetrically disposed on the opposed engaging elements.

25. A slide fastener according to claim 7, wherein a wedge-shaped gap portion is defined at least at a front end of the engaged opposed engaging elements, and the guide portion having an acute angle of the slider is formed to be inserted into the gap portion.

26. A slide fastener according to claim 8, wherein a wedge-shaped gap portion is defined at least at a front end of the engaged opposed engaging elements, and the guide portion having an acute angle of the slider is formed to be inserted into the gap portion.

27. A slide fastener according to claim 9, wherein a wedge-shaped gap portion is defined at least at a front end of the engaged opposed engaging elements, and the guide portion having an acute angle of the slider is formed to be inserted into the gap portion.

* * * * *